US005144883A

United States Patent [19]

Müller et al.

[11] Patent Number: 5,144,883

[45] Date of Patent: Sep. 8, 1992

[54] CYLINDER WITHOUT A PISTON ROD

[75] Inventors: Rudolf Müller, Gehrden; Peter Müller; Norbert Fortmann, both of Hanover, all of Fed. Rep. of Germany

[73] Assignee: Mannesmann Aktiengesellschaft, Düsseldorf, Fed. Rep. of Germany

[21] Appl. No.: 760,406

[22] Filed: Sep. 16, 1991

[30] Foreign Application Priority Data

Sep. 17, 1990 [DE] Fed. Rep. of Germany ..... 4029721

[51] Int. Cl.[5] ..... F01B 9/00

[52] U.S. Cl. ..... 92/137; 92/85 R; 92/177; 92/255; 403/348

[58] Field of Search ..... 92/85 R, 137, 177, 255, 92/256, 257, 258, 259; 403/348, 349

[56] References Cited

U.S. PATENT DOCUMENTS

| | | | |
|---|---|---|---|
| 1,789,570 | 1/1931 | Teetor | 92/257 |
| 2,524,271 | 10/1950 | Rappl | 92/137 |
| 3,745,888 | 7/1973 | Boretti | 92/255 |
| 4,472,981 | 9/1984 | Peter | 74/110 |
| 4,796,515 | 1/1989 | Dry | 92/137 |
| 5,035,171 | 7/1991 | Gottling et al. | 92/137 |

FOREIGN PATENT DOCUMENTS

| | | | |
|---|---|---|---|
| 2245865 | 4/1975 | Fed. Rep. of Germany . | |
| 2938332 | 3/1981 | Fed. Rep. of Germany . | |
| 0043946 | 4/1927 | Norway | 92/137 |
| 0062692 | 7/1924 | Sweden | 92/137 |
| 0932201 | 5/1962 | United Kingdom | 92/137 |

OTHER PUBLICATIONS

German Publication entitled "Kolbenstangenlose Zylinder" published by Knorr; P4311-1/2000/0389.

*Primary Examiner*—Thomas E. Denion

*Attorney, Agent, or Firm*—Nils H. Ljungman and Associates

[57] ABSTRACT

A cylinder without a piston rod comprising a cylinder, a piston for moving along the axial direction within the cylinder, and tension belt means for directing the piston witnin the cylinder. The piston comprises two piston halves which are interconnected by bayonet connection elements. A holding element is held within the piston halves for holding the ends of the tension belt means in place.

14 Claims, 6 Drawing Sheets

CYLINDER WITHOUT A PISTON ROD

BACKGROUND OF THE INVENTION

1. Field of the Invention

This invention relates to a cylinder without a piston rod. In the cylinder without a piston rod, a piston, connected to a tension means, is guided in a cylinder, so that the piston can move in the axial direction. The cross section and/or external circumference of the piston matches the cross section of the cylinder chamber.

2. Background of the Invention

Piston-cylinder aggregates are often used for pneumatic or hydraulic propulsion devices. To reduce the longitudinal dimensions of piston-cylinder aggregates, the prior art omits piston rods and uses flexible tension means to move the piston. The tension means thereby moves a slide, which slide is guided parallel to the axis of movement of the piston. Such drive mechanisms are generally designated cylinders without a piston rod.

Such a cylinder without a piston rod is disclosed in a brochure published by the Knorr Company (No. P 4311-1/2000/0389). In the Knorr Company cylinder without a piston rod, a piston having a round cross section is guided in a correspondingly round cylinder chamber. The piston itself is connected at both ends to the tension means, whereby the tension means is guided outside the cylinder chamber by pulleys installed there, and the tension means is connected to a slide which can move in the axial direction parallel to the axis of movement of the piston. The tension means is fastened eccentrically on the piston, in relation to the longitudinal axis or the center of gravity axis of the piston. Fastening the tension means eccentrically has the disadvantage, however, that during operation the piston experiences a tipping moment in relation to the longitudinal axis of the piston, which leads to uneven wear on the sealing elements. Such a tipping also leads to an uneven sequence of movements of the piston in the cylinder. An additional disadvantage, of these cylinders without a piston rod of the prior art, is the high cost of assembly of the individual elements. This high cost results essentially from the installation and attachment of the tension means.

Laid Open Federal Republic of Germany Patent Application Number DE 29 38 332 A1 discloses an additional work cylinder without a piston rod with tension means, in which the tension means consists of a tension band which is fastened to the piston and which tension band extends beyond the cylinder chamber. The tension band is also deflected outside the cylinder chamber via rollers, so that the linear motion of the piston can be transferred outside the cylinder chamber. For this purpose, certain sizes and dimensions of the cylinder, piston, tension band, and rollers are aimed at achieving a high fatigue strength and high endurance. Such a cylinder without a piston rod also requires a very precise manufacture of the individual parts and a complex assembly process. The cost of this assembly increases with increasing requirements for accuracy and precision of positioning.

OBJECT OF THE INVENTION

On the basis of this prior art, the object of the invention is to create a cylinder without a piston rod, in which the assembly expense is reduced, while maintaining close tolerances and high tensile strength.

SUMMARY OF THE INVENTION

The object is achieved by means of a cylinder without a piston rod of the type described above, in that the piston is divided transversely, and consists of two piston halves which can be joined in the axial direction, in that the piston halves, on their end surfaces facing one another, are equipped with bayonet connection elements, and that the cross section contours of the piston halves, when the piston is assembled, complement one another to form a common, continuous cross section contour. With this cylinder without a piston rod according to the invention, there are a series of advantages, which essentially relate to the assembly and fabrication of such a cylinder without a piston rod. The ends of the tension means can be connected to each one of the piston halves before the piston is assembled. Before the introduction of the piston into the cylinder, the piston halves must then be connected to one another by means of the bayonet connection elements. The piston assembled in this manner thereby forms a continuous cross section contour, which matches the cross section of the cylinder chamber. The advantage is that a simple, secure and rapidly assembled connection is guaranteed between the piston and the ends of the tension means.

In one advantageous configuration of the invention, the piston is provided with a passage extending in the axial direction through both piston halves, and inside the assembled piston, there is a holding element positively connected in the passage to hold the tension means. In an additional advantageous configuration, the passage, in the vicinity of the ends of the piston halves equipped with the bayonet connection elements, has an expanded portion, and the holding element consists of a rotationally symmetrical body extending in the axial direction, which has a thickened portion which fills up the expanded portion of the passage. The overall advantage resulting from this arrangement is that during the installation, the tension means can be easily introduced through the piston halves and can be indirectly connected to the piston with the holding element located inside the piston. On one hand, this makes possible a very time-saving assembly, but from a technical point of view it also offers the advantage that as a result of the indirect connection of the tension means to the piston, the tensile forces which occur during operation are distributed in a radially symmetric fashion. This then leads to a uniform load on the piston and the sealing elements, which means that the wear becomes more uniform and the service life of the equipment is extended. In an additional advantageous configuration of the invention, there is a sealing sleeve located in the outer circumferential region of the piston halves, and damping stops are located in the vicinity of the ends of the piston facing away from the bayonet connection elements. Thus all the sealing and damping elements can be advantageously pre-assembled. In one advantageous configuration, the assembled piston has tubular extensions on the ends pointing outward in the axial direction, into which the ends of the tension means are directed. The advantage consists of a secure non-kinking linkage of the tension means to the piston. In an additional advantageous configuration of the invention, the tension means consist of a tension band, which is sealed to the extensions on the piston holding the tension band by means of gaskets or seals surrounding the tension band, and the holding element has two surrounding seals, which are in contact with the inner surface of the passage in the piston. In this manner, a reliable and rapidly-assembled seal of the entire piston can be advantageously achieved. In an additional advantageous configuration, the ends of the tension band can be connected to the holding element by means of threaded elements, which guarantee a stable connection between the tension band and the piston and also absorbs the forces generated. Such a configuration is particularly well suited for metal tension bands. As an alternative, in one configuration of the invention, when a highly-flexible plastic tension band with wire reinforcement is used, the holding element is provided on both ends with blind holes which hold the wire ends of the tension band. In an additional configuration of the invention corresponding to the use of a highly flexible plastic tension band, the holding element is connected to a comb-like fastening element holding the wire ends of the tension band. In both configurations, the plastic tension band can be easily and advantageously connected to the holding element by squeezing or pressing the wire ends into the blind holes or into the comb-like fastening elements. That is, the wire ends are inserted into the blind holes or comb-like fastening elements, and then the blind holes or comb-like fastening elements are deformed in some manner, so that the wire ends are held securely.

In an additional advantageous configuration of the invention, the cross section contour of the piston and the cylinder chamber has an oval configuration. This configuration results in a particularly advantageous configuration of the invention. A piston-cylinder aggregate having an oval or elliptical cross section is, in itself, disclosed in Laid Open French Patent Application Publication Number 2 245 865, but in that version of the prior art its objective is to achieve a compact structure, and also to prevent the piston from rotating in the cylinder. The object of the oval piston in the advantageous configuration according to the invention is altogether different.

The piston is oval, so that the bayonet connection elements can be designed so simply that there is no need for a locking mechanism, i.e. protection against twisting or unlocking of the bayonet connection elements, since the assembled piston will be held in a self-locking manner inside the oval cylinder chamber by means of its oval configuration. In other words, the piston halves cannot rotate in relation to one another, and thus open the lock, even unintentionally.

An additional advantageous configuration is a cylinder without a piston rod, comprising cylinder means, the cylinder means having an axial direction therewithin; a piston for moving along the axial direction within the cylinder means, the piston having an axial direction; force drive means; tension belt means for transferring movement of the piston to the force drive means, the tension belt means being connected between the force drive means and the piston; a plurality of rollers for directing the tension belt means; the piston comprising two piston portions; and the piston portions comprising interconnecting means, the interconnecting means for interconnecting the piston portions.

An additional advantageous configuration is a cylinder without a piston rod, comprising cylinder means, the cylinder means having an axial direction therewithin; a piston for moving along the axial direction within the cylinder means, the piston having an axial direction; tension belt means for directing the piston along the axial direction within the cylinder means, the tension belt means being connected to the piston; the piston comprising two piston portions; and the piston portions comprising interconnecting means, the interconnecting means for interconnecting the piston portions.

BRIEF DESCRIPTION OF THE DRAWINGS

One embodiment of the invention is illustrated in the accompanying drawing and explained below in greater detail.

FIG. 3*a*' shows an alternative rear axial view of a piston half.

DESCRIPTION OF THE PREFERRED EMBODIMENTS

Figure 1A:
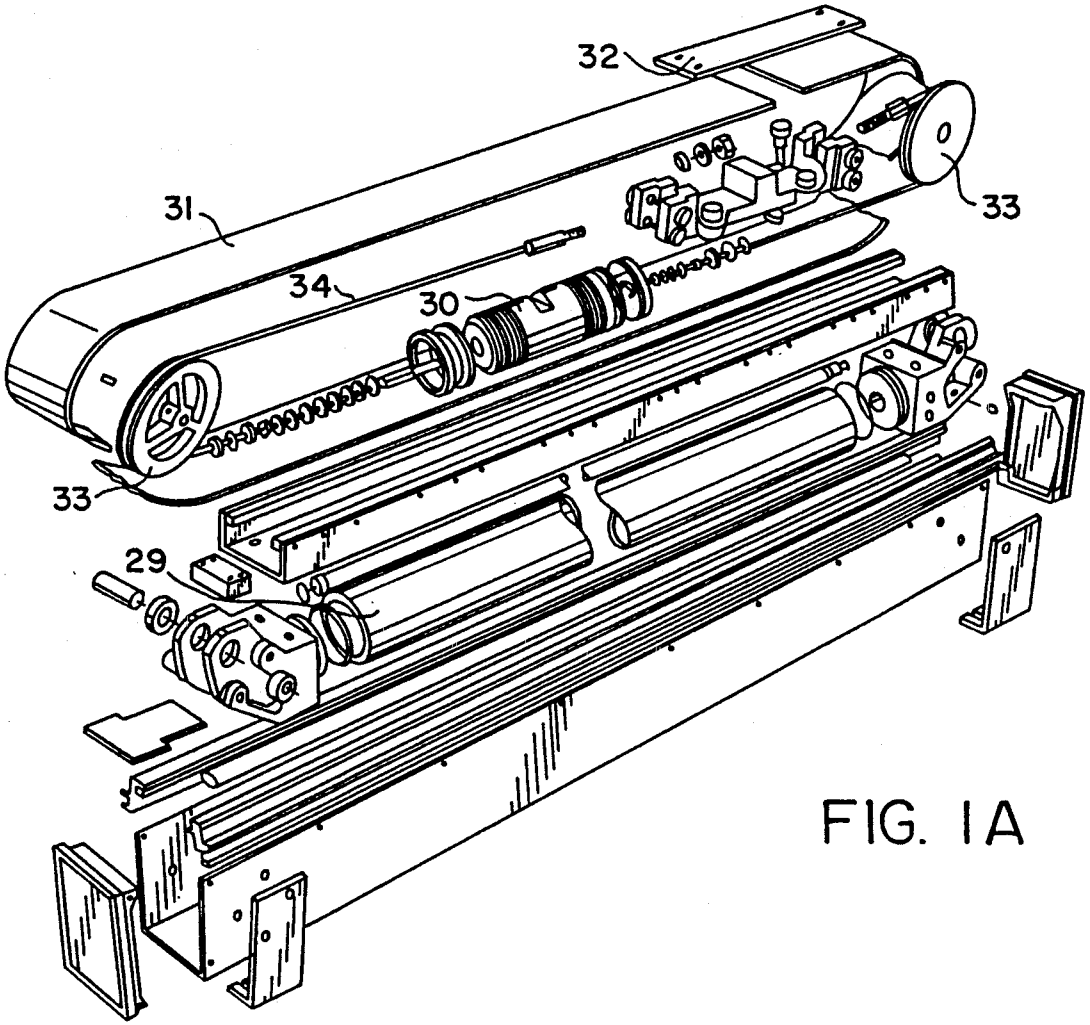
FIG. 1A shows a tension band cylinder.

FIG. 1A shows the cylinder without a piston rod which consists essentially of a cylinder 29, a piston 30, deflecting rollers or pulleys 33, a belt 31, a cable 34, and force drive 32. Cable 34 is attached to piston 30 and runs over pulleys 33. Pulleys 33 contact belt 31. Belt 31 is connected to force drive 32. The transfer of force by piston 30 is through cable 34 to pulleys 33. Pulleys 33 transfer the force through belt 31 to force drive 32.

Figure 1B:
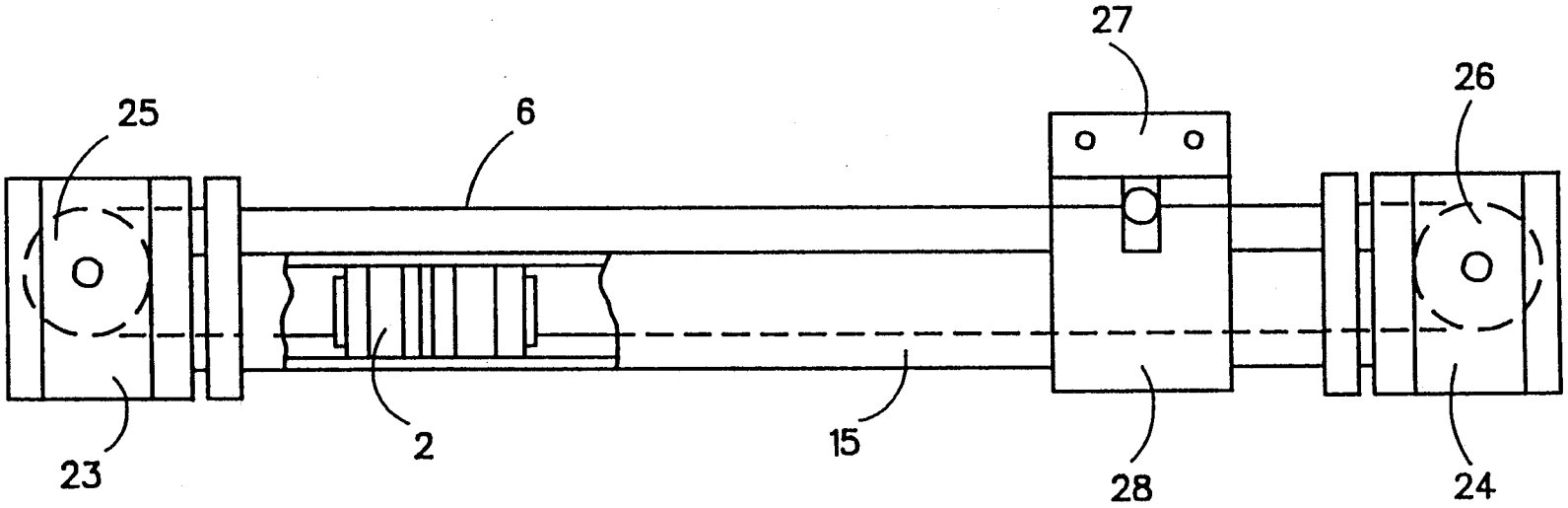
FIG. 1B shows a tension band cylinder.

FIG. 1B shows the cylinder without a piston rod which consists essentially of a cylinder 15, a piston 2, cylinder heads 23, 24, deflecting rollers 25, 26, a belt 6 attached to piston 2 and running over the deflector rollers 25, 26 and carrying an external force drive 27 which may be integral with guide bushing 28. The transfer of force is affected by piston 2 through belt 6 to force drive 27.

Figure 1:
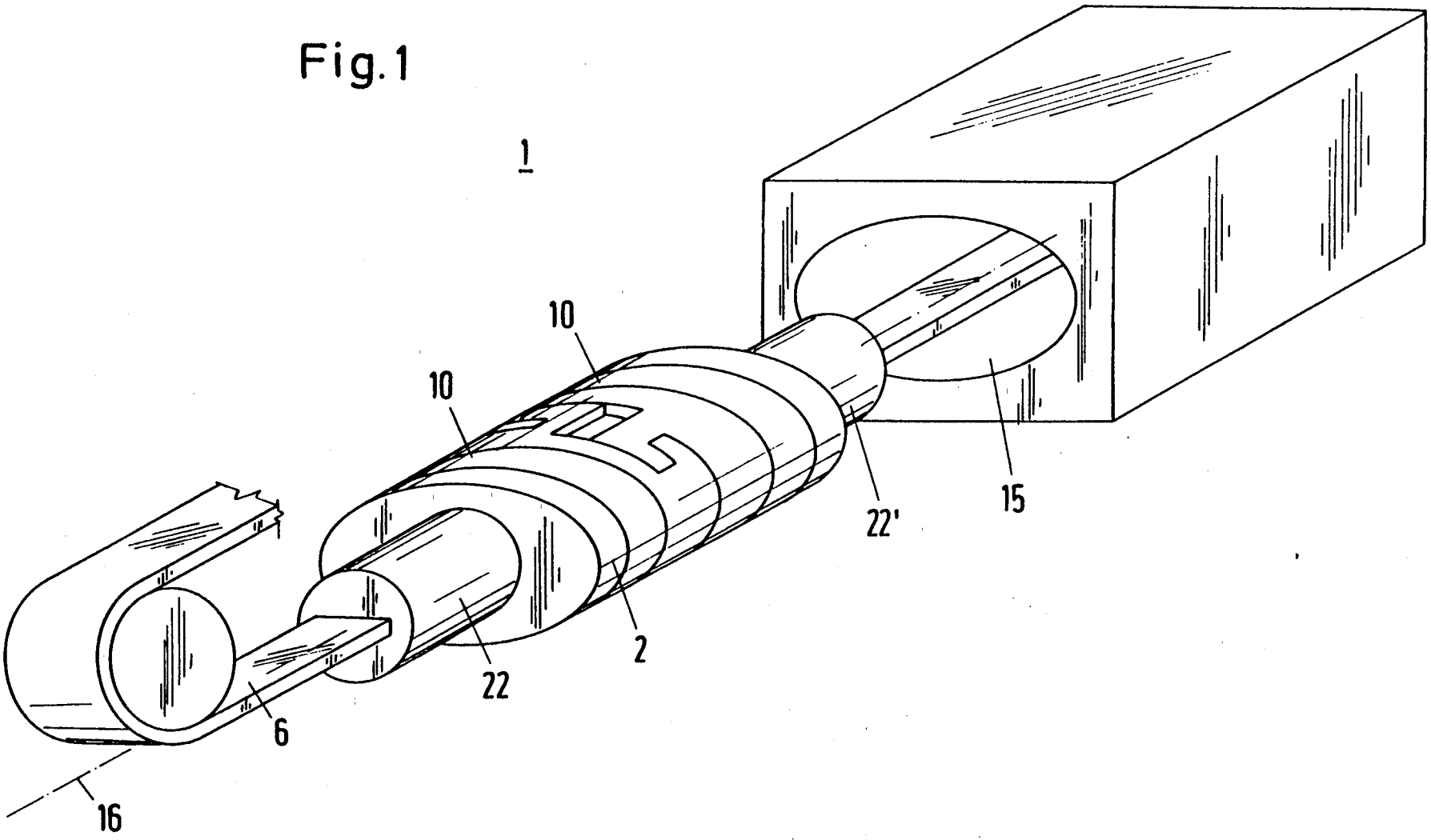
FIG. 1 shows a schematic illustration of a tension band cylinder.

FIG. 1 shows the entire cylinder without a piston rod 1 which has a tension band 6, an oval cylinder chamber 15 and an oval piston 2. The piston band 6 is directed along the longitudinal axis 16 running through the center of gravity of the piston 2 into the extensions 22 and 22' of the piston 2. In this manner, a uniform load is applied to the sealing sleeves 10, and the entire piston 2 is uniformly guided and without any tipping forces acting on it. In other words, the tension band 6 is centered with respect to the cross section contour of the piston 2, so that the piston band 6 is directed through the center of the piston 2.

Figure 2:
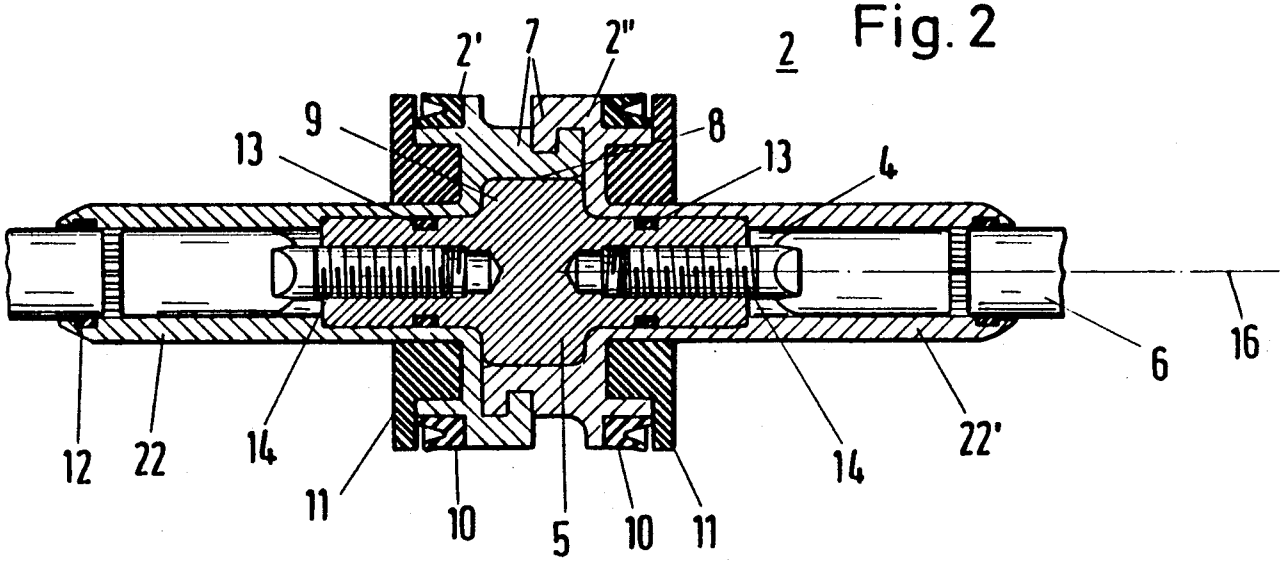
FIG. 2 shows a top view of a partial longitudinal section of a piston.

FIG. 2 is a detailed illustration of the whole, assembled piston 2 with the holding element 5 and the ends of the tension belt being directed into it. The piston halves 2', 2'' and the entire piston, when assembled, occupies the cross section of the cylinder chamber 15 only over a portion of the cylinder chamber 15 length. The sealing sleeves 10 are partly recessed into the outside circumference of the piston 2, so that they have a secure grip. The damping stops 11 limit the stroke of the piston 2 and are therefore located at the appropriate point. The ends of the piston 2 pointing axially outward are provided with tubular extensions 22, 22', and in this manner guide the inserted ends of the tension band 6. The bayonet connection elements 7 are configured so that they form a type of bayonet connection, in which the piston halves 2', 2'' are axially brought together and need only be rotated a partial turn. In this case, the piston 2 has an oval configuration, so that locking elements which stop the bayonet joint formed in this manner are not necessary, because the oval piston 2 is guided in the oval cylinder chamber 15, so that it is protected against twisting and unlocking. The holding element 5 here is a swivelling part which is rotationally symmetrical in relation to the longitudinal axis 16 of the piston, and which with its thickened segment 9 is positively engaged with the expanded portion 8 of the passage 4 of the piston 2, so that when tensile forces are exerted, the holding element 5 does not move axially relative to the passage 4 of the piston 2. That is, the holding element 5 is part of the piston 2 and moves with the piston 2. The gaskets 13 seal the passage opening 4 of the piston 2.

Figure 2A:
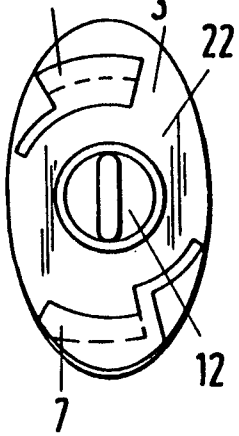
FIG. 2*a* a shows a front axial view of a piston half.

FIG. 2*a* shows the left piston half 2' with a view of the bayonet connection elements 7. The oval contour is clearly visible in this figure. The tension band 6 has a rectangular base cross section with rounded narrow sides, and is sealed by a correspondingly O-ring-like gasket 12. The two piston halves 2', 2'' are here identical in all details, so that for the manufacture of such piston halves using injection molding technology, for example, only a single injection mold is necessary. The cross section contour or the external circumference of the piston is finally formed by the sealing sleeves 10.

Figure 3A:
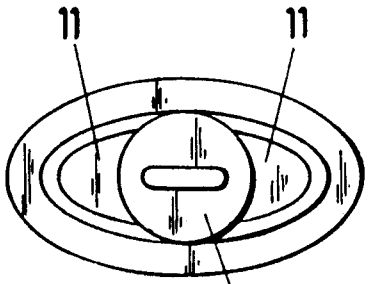
FIG. 3*a* shows a rear axial view of a piston half.
Figure 3:
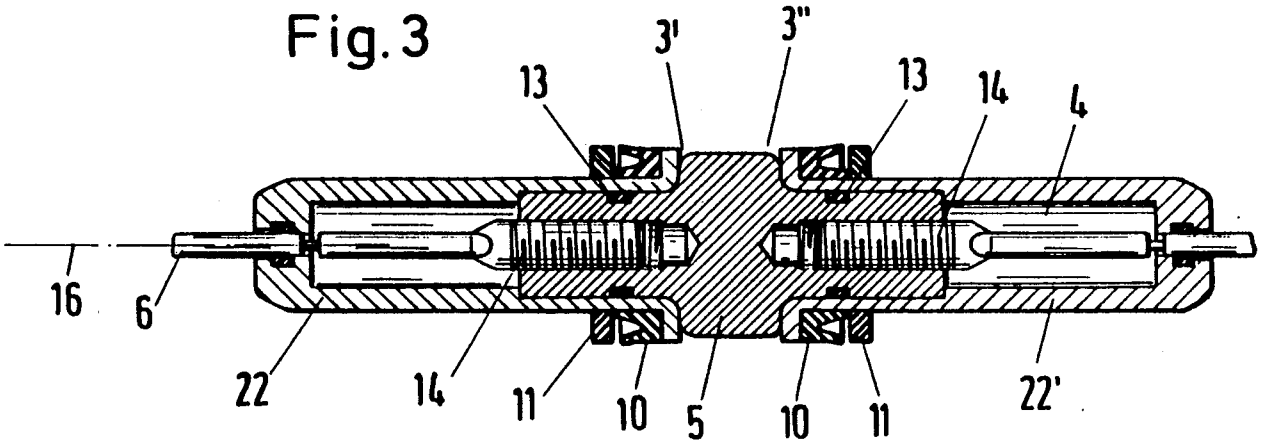
FIG. 3 shows a side view of a partial longitudinal section of a piston (the section is rotated 90 degrees around the longitudinal axis of the piston when compared to FIG. 2).
Figure 3A:
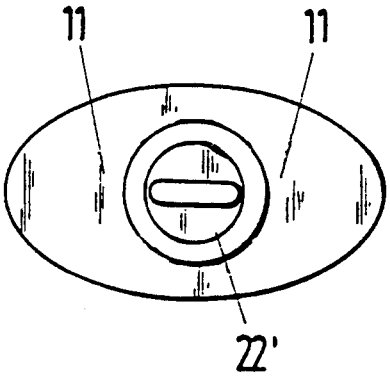

FIG. 3 shows the piston in FIG. 2 rotated around the longitudinal axis 16 by 90 degrees and in longitudinal section. FIG. 3*a* shows the rear view of a piston half in the axial direction. FIG. 3*a'* shows an alternative of the rear view of a piston half in the axial direction. FIG. 3 shows that the bayonet connection elements 7 do not extend over the entire circumferential area of the piston 2, but are located only in the vicinity of the major vertices (See also FIG. 2*a*.). Furthermore, in this illustration, the O-ring configuration of the tension band seal 12 and the cross section contour of the tension band 6 are apparent. If a wire-reinforced plastic tension band is used, this tension band seal 12 is particularly important to prevent a "swelling" of the tension band in the vicinity of the wires. The threaded elements 14 for the attachment of the ends of the tension band to the holding element 5 are also on a common axis, which in this case also forms the central longitudinal or center of gravity axis 16 of the piston. It is thereby clear that the damping stops 11 do not have a closed ring shape, but are designed only as segments which are located in the vicinity of the high vertices. That is, the high points of the piston half, which are pictured in FIG. 3*a* as an oval continuous with extension 22', are the only parts of the piston affected by the damping stops 11. Since the high points are not a continuous ring but are broken into two portions, the damping stops 11 are also segmented. However, the damping stops 11 can be made to encircle the extension 22'.

Figure 4:
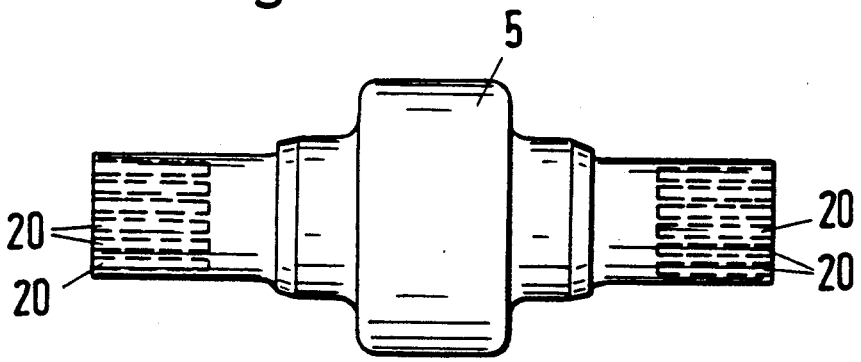
FIG. 4 shows a top view of a holding element with blind holes.

FIG. 4 shows the holding element 5 with the blind holes 20 located on both ends, into which the wire ends of the tension band, stripped of the plastic, can be introduced and then pressed or crushed.

Figure 4A:
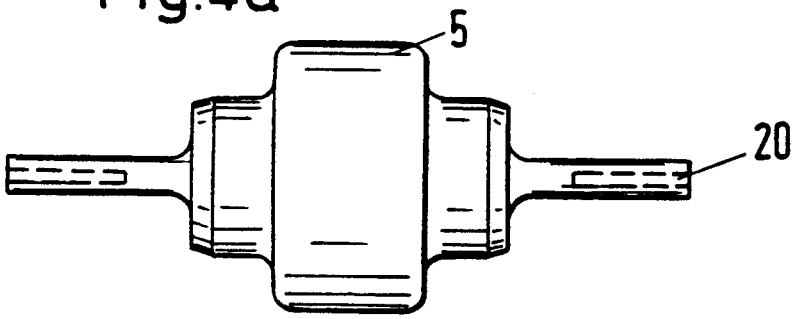
FIG. 4*a* shows a side view of a holding element with blind holes.

FIG. 4*a* shows FIG. 4 in a side view. It is clear that the ends of the holding element can also be flattened, for example, to retain the wire ends of the tension band.

Figure 5:
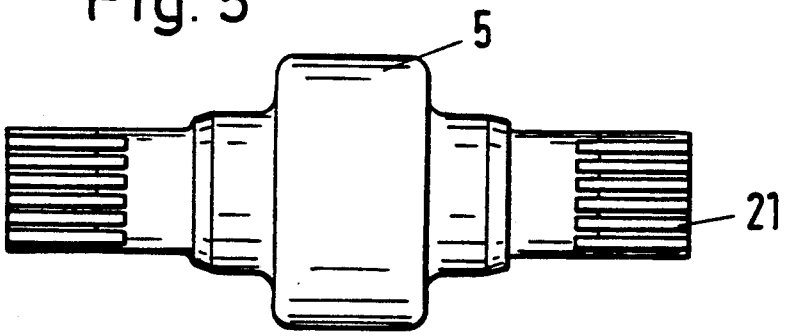
FIG. 5 shows a top view of a holding element with comb-like fastening elements.

FIG. 5 shows the holding element 5 with the comb-like fastening elements 21 located at both ends, which can also be pressed or crushed after the introduction of the wire ends of the tension band.

Figure 5A:
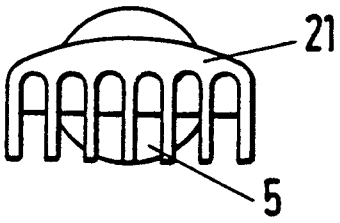
FIG. 5*a* shows a front view of a holding element with comb-like fastening elements.

In FIG. 5*a*, the comb-like configuration of the fastening element 5 is clear in the front view of FIG. 5.

Overall, this cylinder without a piston rod makes possible an assembly process providing rapid and reliable operating conditions. Given the configuration of the piston halves, it is also conceivable that the piston can be a combination of non-identical piston halves. One possibility, for example, would be to shape the end surfaces of the piston halves facing one another in the form of pegs, so that the peg-shaped extensions, when the complementary bayonet connection elements are twisted together, form a joint, continuous cross section contour. That is, rather than each piston half each having the same contour as the cylinder, the piston halves would compliment one another such that when combined the pegs together would form the entire cylinder contour.

The tension means can also be a cable or a chain.

One aspect of the invention resides in a cylinder without a piston rod, in which a piston connected to a tension means is guided so that it can move in the axial direction, where the cross section and/or external circumference of the piston matches the cross section of the cylinder chamber, characterized by the fact that the piston 2 is divided transversely and consists of two piston halves 2', 2'' which can be joined in the axial direction, that the piston halves 2, 2'' have bayonet connection elements 7 on the end surfaces 3, 3'' facing one another, and that the cross section contours of the piston halves 2', 2'', when the piston 2 is joined or assembled, combine to form a joint, continuous cross section contour.

Another aspect of the invention is a cylinder without a piston rod characterized by the fact that the piston has a passage 4 extending in the axial direction through both piston halves 2', 2'', and that inside the assembled piston 2 there is a holding element 5 to hold the tension means 6 positively in the passage 4.

Yet another aspect of the invention is a cylinder without a piston rod characterized by the fact that the passage 4 has an expanded part 8 in the vicinity of the ends of the piston halves 2', 2'' which have the bayonet connection elements 7.

A further aspect of the invention is a cylinder without a piston rod characterized by the fact that the holding element 5 consists of a rotationally- symmetrical body extending in the axial direction, which has a thicker portion 9 which fills up the expanded portion 8 of the passage 4.

A yet further aspect of the invention is a cylinder without a piston rod characterized by the fact that in the outer circumferential region of each of the piston halves 2', 2'', there is a sealing sleeve 10, and damping stops 11 are located in the vicinity of the ends of the piston 2 facing away from the bayonet connection elements 7.

Yet another further aspect of the invention is a cylinder without a piston rod characterized by the fact that the piston 2, when assembled, is provided has tubular extensions 22, 22' on the ends pointing outward in the axial direction, into which the ends of the tension means 6 are directed.

An additional aspect of the invention is a cylinder without a piston rod characterized by the fact that the tension means 6 are a tension band, and that on the extensions 22, 22' of the piston 2 holding the tension band, there are seals 12 surrounding the tension band.

A yet additional aspect of the invention is a cylinder without a piston rod characterized by the fact that the holding element 5 has two surrounding seals or gaskets 13, which are in contact with the inner surface of the passage 4 of the piston 2.

A further additional aspect of the invention is a cylinder without a piston rod characterized by the fact that the ends of the tension band can be connected to the holding element 5 by means of threaded elements 14.

A yet further additional aspect of the invention is a cylinder without a piston rod characterized by the fact that when a wire-reinforced plastic tension band is used, the holding element 6 is provided on both ends, at the same interval as the wires located parallel to one another in the tension band, with blind holes 20 which receive the wire ends of the tension band.

Another yet further aspect of the invention is a cylinder without a piston rod characterized by the fact that when a wire-reinforced plastic tension band is used, the holding element is connected on both ends to a comb-like fastening element 21 which holds the wire ends of the tension band.

A still further aspect of the invention is a cylinder without a piston rod characterized by the fact that the cross section contour of the piston 2 and of the cylinder chamber 15 is oval.

Similar cylinders without piston rods are disclosed in the U.S. Pat. No. 5,020,421, 4,796,515, and 4,472,981.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A cylinder without a piston rod, comprising:

cylinder means, said cylinder means having an axial direction therewithin;

a piston for moving along the axial direction within said cylinder means, said piston having an axial direction;

force drive means;

tension belt means for transferring movement of said piston to said force drive means, said tension belt means being connected between said force drive means and said piston;

a plurality of rollers for directing said tension belt means;

said piston comprising two piston portions;

said piston portions comprising interconnecting means, said interconnecting means for interconnecting said piston portions; wherein said piston portions are piston halves, which piston halves divide said piston transversely, and said piston halves have substantially the same axial cross sections for forming a continuous cross section contour upon interconnecting said piston halves;

said interconnecting means comprises bayonet connection elements which connect said piston halves in the axial direction of said piston; and wherein said piston comprises:

a passage extending in the axial direction through both piston halves; and a holding element in said passage of said piston, said holding element for holding said tension belt means positively in said passage.

2. The cylinder without a piston rod of claim 1, wherein said passage comprises an expanded part in the vicinity of the ends of said piston halves being connected by said bayonet connection elements.

3. The cylinder without a piston rod of claim 2, wherein said holding element comprises a rotationally-symmetrical body extending in the axial direction, and said holding element comprises a thicker portion, which thicker portion of said holding element fills up said expanded part of said passage.

4. The cylinder without a piston rod of claim 3, wherein said piston comprises:

a sealing sleeve on an outer circumferential region of each of said piston halves, said sealing sleeve for sealing between said piston and said cylinder means; and a plurality of damping stops which are located in the vicinity of ends of the piston, which ends of the piston face away from the bayonet connection elements.

5. The cylinder without a piston rod of claim 4, wherein said piston comprises tubular extensions on the piston ends facing away from the bayonet connection elements, said tubular extensions extend in the axial direction, said tubular extensions comprising ends, said tension belt means being directed into said ends of said tubular extensions.

6. The cylinder without a piston rod of claim 5, wherein said tension belt means comprises a tension band, and said tubular extensions of said piston into which said tension band is directed comprise seals surrounding said tension band.

7. The cylinder without a piston rod of claim 6, wherein:

said holding element comprises a plurality of surrounding seals, said plurality of surrounding seals for sealing between said holding element and said passage;

said tension band comprises a wire-reinforced plastic tension band, said wire-reinforced plastic tension band comprises wires arranged parallel to one another, said wires arranged parallel to one another having ends, and said holding element comprises one of:

a. blind holes on both ends of said holding element, said blind holes being at the same interval as said wire ends arranged parallel to one another in said tension band, and said blind holes for receiving said wire ends, and b. a comb-like fastening element on both ends of said holding element, said comb-like fastening element for holding said wire ends;

said continuous cross section contour of said piston and of said cylinder means being oval; and said tension band being centered with respect to said cross section contour of said piston.

8. A cylinder without a piston rod, comprising:

cylinder means, said cylinder means having an axial direction therewithin;

a piston for moving along the axial direction within said cylinder means, said piston having an axial direction;

tension belt means for directing said piston along the axial direction within said cylinder means, said tension belt means being connected to said piston;

said piston comprising two piston portions;

said piston portions comprising interconnecting means, said interconnecting means for interconnecting said piston portions; and wherein:

said piston portions are piston halves, which piston halves divide said piston transversely, and said piston halves have substantially the same axial cross sections for forming a continuous cross section contour upon interconnecting said piston halves;

said interconnecting means comprises bayonet connection elements which connect said piston halves in the axial direction of said piston; and wherein said piston comprises:

a passage extending in the axial direction through both piston halves; and a holding element in said passage of said piston, said holding element for holding said tension belt means positively in said passage.

9. The cylinder without a piston rod of claim 8, wherein said passage comprises an expanded part in the vicinity of the ends of said piston halves being connected by said bayonet connection elements.

10. The cylinder without a piston rod of claim 9, wherein said holding element comprises a rotationally-symmetrical body extending in the axial direction, and said holding element comprises a thicker portion, which thicker portion of said holding element fills up said expanded part of said passage.

11. The cylinder without a piston rod of claim 10, wherein said piston comprises:

a sealing sleeve on an outer circumferential region of each of said piston halves, said sealing sleeve for sealing between said piston and said cylinder means; and a plurality of damping stops which are located in the vicinity of ends of the piston, which ends of the piston face away from the bayonet connection elements.

12. The cylinder without a piston rod of claim 11, wherein said piston comprises tubular extensions on the piston ends facing away from the bayonet connection elements, said tubular extensions extend in the axial direction, said tubular extensions comprising ends, said tension means being directed into said ends of said tubular extensions.

13. The cylinder without a piston rod of claim 12, wherein said tension belt means comprises a tension band, and said tubular extensions of said piston into which said tension band is directed comprise seals surrounding said tension band.

14. The cylinder without a piston rod of claim 13, wherein:

said holding element comprises a plurality of surrounding seals, said plurality of surrounding seals for sealing between said holding element and said passage;

said tension band comprises a wire-reinforced plastic tension band, said wire-reinforced plastic tension band comprises wires arranged parallel to one another, said wires arranged parallel to one another having ends, and said holding element comprises one of:

a. blind holes on both ends of said holding element, said blind holes being at the same interval as said wire ends arranged parallel to one another in said tension band, and said blind holes for receiving said wire ends, and b. a comb-like fastening element on both ends of said holding element, said comb-like fastening element for holding said wire ends;

said continuous cross section contour of said piston and of said cylinder means being oval; and said tension band being centered with respect to said cross section contour of said piston.

* * * * *

UNITED STATES PATENT AND TRADEMARK OFFICE

CERTIFICATE OF CORRECTION

PATENT NO. : 5,144,883

DATED : September 8, 1992

INVENTOR(S) : Rudolf MÖLLER, Peter MÜLLER and Norbert FORTMANN

It is certified that error appears in the above-identified patent and that said Letters Patent is hereby corrected as shown below:

On the title page, item [19]:

"Müller et al." and insert --Möller et al.--.

On the title page, item [75]:

'Rudolf,' delete "Müller" and insert --Möller--.

On the title page, item [75]:

of' delete "Hanover" and insert --Hannover--.

On the title page, item [57]:

Abstract, line 4, please delete "witnin" and insert --within--.

Signed and Sealed this

First Day of February, 1994

*Attest:*

*Attesting Officer*

BRUCE LEHMAN

*Commissioner of Patents and Trademarks*